US010421121B2

(12) United States Patent
Satoh et al.

(10) Patent No.: US 10,421,121 B2
(45) Date of Patent: Sep. 24, 2019

(54) METHOD OF MANUFACTURING NI ALLOY CASTING AND NI ALLOY CASTING

(71) Applicant: IHI CORPORATION, Koto-ku (JP)

(72) Inventors: Shigeyuki Satoh, Tokyo (JP); Yoshiki Kato, Tokyo (JP); Tatsuya Sekiguchi, Tokyo (JP)

(73) Assignee: IHI Corporation, Koto-ku (JP)

( * ) Notice: Subject to any disclaimer, the term of this patent is extended or adjusted under 35 U.S.C. 154(b) by 229 days.

(21) Appl. No.: 15/661,513

(22) Filed: Jul. 27, 2017

(65) Prior Publication Data

US 2017/0320133 A1 Nov. 9, 2017

Related U.S. Application Data

(63) Continuation of application No. PCT/JP2016/051361, filed on Jan. 19, 2016.

(30) Foreign Application Priority Data

Feb. 3, 2015 (JP) ..... 2015-019261

(51) Int. Cl.

| | |
|---|---|
| ***B22D 27/20*** | (2006.01) |
| ***B22D 21/00*** | (2006.01) |
| ***C22C 1/02*** | (2006.01) |
| ***C22C 19/05*** | (2006.01) |
| ***F04D 29/38*** | (2006.01) |
| ***F01D 5/28*** | (2006.01) |
| ***B22D 27/04*** | (2006.01) |

(52) U.S. Cl.

CPC ..... *B22D 27/20* (2013.01); *B22D 21/00* (2013.01); *B22D 21/005* (2013.01); *B22D 27/045* (2013.01); *C22C 1/02* (2013.01); *C22C 19/05* (2013.01); *F01D 5/28* (2013.01); *F04D 29/38* (2013.01); *F05D 2230/21* (2013.01); *F05D 2300/177* (2013.01)

(58) Field of Classification Search

CPC ..... B22D 27/20; B22D 21/005; C22F 1/10; C22C 19/057

See application file for complete search history.

(56) References Cited

U.S. PATENT DOCUMENTS

| | | | |
|---|---|---|---|
| 4,905,752 | A | 3/1990 | Rama Prasad |
| 5,577,547 | A | 11/1996 | Hosamani |
| 5,611,670 | A | 3/1997 | Yoshinari et al. |
| 2013/0160967 | A1 | 6/2013 | Suzuki et al. |
| 2014/0127032 | A1 | 5/2014 | Naik |
| 2019/0032492 | A1 | 1/2019 | Naik |

FOREIGN PATENT DOCUMENTS

| | | | |
|---|---|---|---|
| CN | 1123874 | A | 6/1996 |
| CN | 101294250 | A | 10/2008 |
| EP | 0 484 025 | A1 | 5/1992 |
| EP | 0 530 968 | A1 | 3/1993 |
| JP | 51-50814 | | 5/1976 |
| JP | 57-184572 | | 11/1982 |
| JP | 3-134201 | | 6/1991 |
| JP | 5-200529 | | 8/1993 |
| JP | 2002-331353 | | 11/2002 |
| JP | 2010-75999 | A | 4/2010 |
| JP | 2013-136097 | | 7/2013 |
| JP | 2014-100731 | A | 6/2014 |
| JP | 2014-131816 | | 7/2014 |

OTHER PUBLICATIONS

Office Action dated Dec. 4, 2018 in Japanese Patent Application No. 2015-019261.

Extended European Search Report dated Jun. 29, 2018 in European Patent Application No. 16746406.4, 8 pages.

Combined Chinese Office Action and Search Report dated Aug. 3, 2018 in Chinese Patent Application No. 201680007038.9 (with English translation of Category of Cited Documents), 9 pages.

International Search Report dated Apr. 26, 2016 in PCT/JP2016/051361, filed Jan. 19, 2016 (with English Translation).

Written Opinion dated Apr. 26, 2016 in PCT/JP2016/051361, filed Jan. 19, 2016.

Official Action dated Apr. 16, 2019, in the counterpart Chinese application No. 2016800070389.

Official Action dated Jun. 4, 2019 in the counterpart Japanese application No. 2015-019261.

Principles of Material Forming, Zhao Hongyun, Beijing: National Defense Industry Press, 2009.9, pp. 239-243).

*Primary Examiner* — Jessee R Roe

(74) *Attorney, Agent, or Firm* — Oblon, McClelland, Maier & Neustadt, L.L.P.

(57) ABSTRACT

A method of manufacturing a Ni alloy casting, includes a casting step of casting molten Ni alloy by pouring the molten Ni alloy into a cavity of a mold, a columnar grain forming step of forming columnar grain by solidifying the molten Ni alloy while drawing the mold, in which the molten Ni alloy has been poured, at a drawing speed of 100 mm/hour or more but 400 mm/hour or less with a temperature gradient provided to a solid-liquid interface, and an equiaxed grain forming step of forming equiaxed grain by solidifying the molten Ni alloy while drawing the mold at a drawing speed of 1000 mm/minute or more continuously after the columnar grain forming step.

20 Claims, 6 Drawing Sheets

METHOD OF MANUFACTURING NI ALLOY CASTING AND NI ALLOY CASTING

CROSS REFERENCE TO RELATED APPLICATIONS

This application is a continuation application of International Application No. PCT/JP2016/051361, filed on Jan. 19, 2016, which claims priority to Japanese Patent Application No. 2015-019261, filed on Feb. 3, 2015, the entire contents of which are incorporated by references herein.

BACKGROUND

1. Field

This disclosure relates to a method of manufacturing a Ni alloy casting and a Ni alloy casting.

2. Description of the Related Art

An example of a Ni alloy casting is a turbine blade formed by casting a Ni alloy. Its airfoil portion has creep strength, while its dovetail portion has fatigue strength. For this reason, when a turbine blade is cast by making the airfoil and dovetail portions of the turbine blade respectively have columnar grain structure and equiaxed structure, the resultant turbine blade can have excellent strength characteristics.

Japanese Patent Application Publication No. Hei 3-134201 (Patent Literature 1) discloses a method of manufacturing a turbine blade made of a Ni-based alloy with its airfoil and dovetail portions respectively having columnar grain structure and equiaxed structure. According to PTL1, in the first casting step, as large an amount of alloy as the volume of the airfoil portion is cast and unidirectionally solidified to form columnar grain structure, and in the second casting step, an additional amount of alloy is poured and cast to form equiaxed structure.

SUMMARY

In the case where, however, a Ni alloy casting having the columnar grain structure and equiaxed structure is manufactured through several casting steps as discussed in PTL1, there is a possibility that the productivity of the Ni alloy casting decreases because of the increased number of casting steps, the complicatedness of the casting work and the like.

With this taken into consideration, an object of this disclosure is to provide a method of manufacturing a Ni alloy casting and a Ni alloy casting which make it possible to improve productivity of the Ni alloy casting.

A method of manufacturing a Ni alloy casting according to the present disclosure includes a casting step of casting molten Ni alloy by pouring the molten Ni alloy into a cavity of a mold, a columnar grain forming step of forming columnar grain by solidifying the molten Ni alloy while drawing the mold, in which the molten Ni alloy has been poured, at a drawing speed of 100 mm/hour or more but 400 mm/hour or less with a temperature gradient provided to a solid-liquid interface, and an equiaxed grain forming step of forming equiaxed grain by solidifying the molten Ni alloy while drawing the mold at a drawing speed of 1000 mm/minute or more continuously after the columnar grain forming step.

In a method of manufacturing a Ni alloy casting according to the present disclosure, the mold includes a grain refined layer in a cavity-side portion of the mold, the grain refined layer containing a grain refining agent of a cobalt compound, and in the columnar grain forming step, the temperature gradient of the solid-liquid interface is set at 80° C./cm or more.

In a method of manufacturing a Ni alloy casting according to the present disclosure, the mold includes a grain refined layer in an equiaxed grain forming area in a cavity-side portion of the mold, the grain refined layer containing a grain refining agent of a cobalt compound, and the mold includes no grain refined layer in a columnar grain forming area in the cavity-side portion of the mold.

In a method of manufacturing a Ni alloy casting according to the present disclosure, the grain refining agent is any one of cobalt aluminate, cobalt oxide, cobalt acetate, cobalt sulfate, cobalt chloride, cobalt sulfonate, ammonium cobalt sulfate, cobalt thiocyanate and cobalt nitrate.

In a method of manufacturing a Ni alloy casting according to the present disclosure, the Ni alloy casting is a turbine blade, an airfoil portion of the turbine blade is made from the columnar grain, and a dovetail portion of the turbine blade is made from the equiaxed grain.

A Ni alloy casting according to the present disclosure is a Ni alloy casting manufactured using any one of the above methods of manufacturing a Ni alloy casting, in which a grain size of the columnar grain in a direction orthogonal to a direction of the drawing is in a range of 0.45 mm to 0.55 mm.

According to the foregoing configuration, the continuous change in the drawing speed after the casting makes it possible to form the columnar grain and thereafter continuously the equiaxed grain. For this reason, the productivity of the Ni alloy casting can be improved.

DESCRIPTION OF EMBODIMENTS

Using the drawings, detailed descriptions will be hereinbelow provided for an embodiment of the present disclosure.

Figure 1:
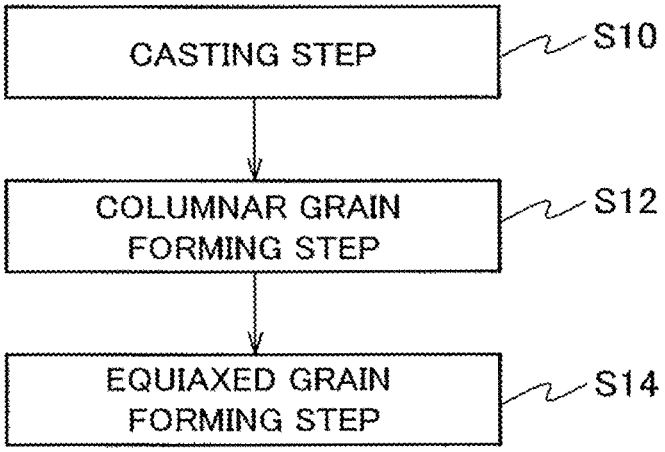
FIG. 1 is a flowchart illustrating a configuration of a method of manufacturing a Ni alloy casting in an embodiment of the present disclosure.

FIG. 1 is a flowchart illustrating a configuration of a method of manufacturing a Ni alloy casting. The method of manufacturing a Ni alloy casting includes a casting step (S10), a columnar grain forming step (S12) and an equiaxed grain forming step (S14).

Figure 2:
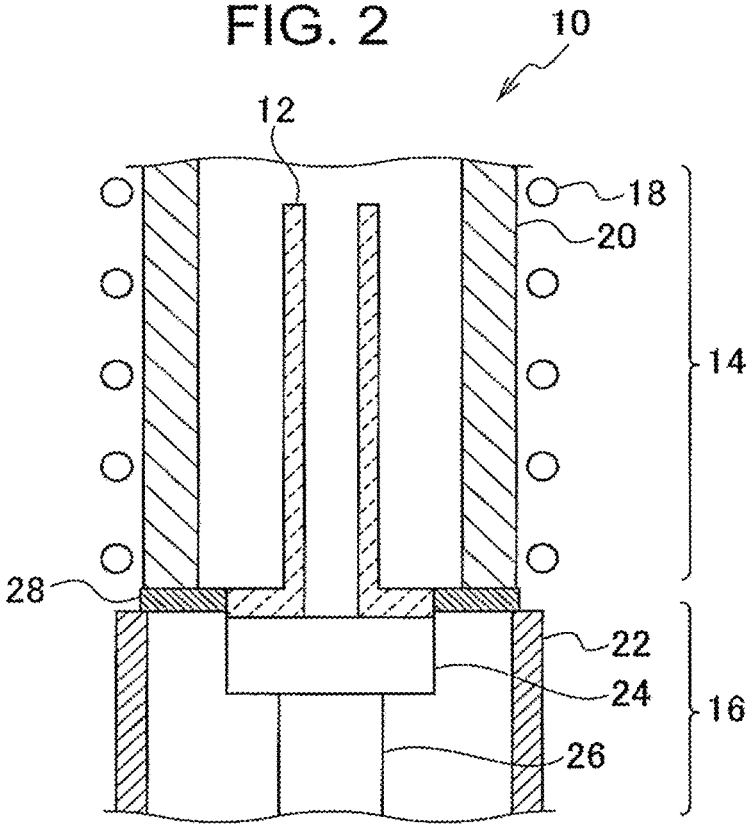
FIG. 2 is a diagram illustrating a configuration of a casting apparatus in the embodiment of the present disclosure.

To begin with, descriptions will be provided for a casting apparatus for casting the Ni alloy casting. FIG. 2 is a diagram illustrating a configuration of the casting apparatus 10.

The casting apparatus 10 includes a chamber (not illustrated) such as a vacuum chamber, and a melting crucible (not illustrated) for melting Ni alloy raw materials. The casting apparatus 10 is provided with a heating zone 14 for heating a mold 12, and a cooling zone 16 for cooling the mold 12. The heating zone 14 includes a heater 18 and a susceptor 20. The cooling zone 16 includes a water-cooling chill ring 22, a water-cooling chill plate 24 and an elevating member 26. The water-cooling chill plate 24 is attached to the elevating member 26. The mold 12 placed on the water-cooling chill plate 24 is movable to the heating zone 14 and the cooling zone 16. A heat shielding plate 28 for shielding heat is provided between the heating zone 14 and the cooling zone 16. As the casting apparatus 10, a general casting apparatus to be used for the unidirectional solidification casting of a metal material such as a Ni alloy may be used.

Figure 3:
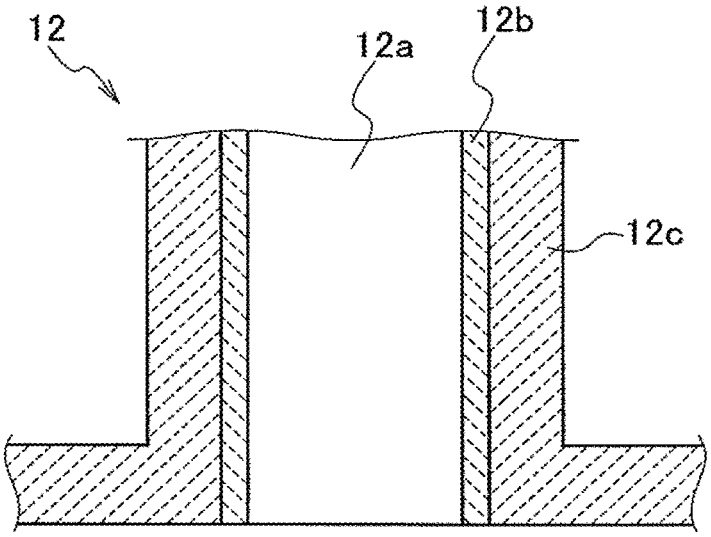
FIG. 3 is a diagram illustrating a configuration of a mold in the embodiment of the present disclosure.

Next, descriptions will be provided for the mold 12. FIG. 3 is a diagram illustrating a configuration of the mold 12. The mold 12 includes a cavity 12*a* for pouring molten Ni alloy. The mold 12 includes a grain refined layer 12*b* provided at the side of the cavity 12*a*, and a backup layer 12*c* provided outside the grain refined layer 12*b*.

The grain refined layer 12*b* is made from a mixture of a refractory material and a grain refining agent of a cobalt compound. The grain refined layer 12*b* has a function of refining the grain. The grain refining agent of the cobalt compound functions as a nucleating agent for forming a number of crystal nuclei by its contact with the molten Ni alloy. Since the grain refined layer 12*b* provided to the mold 12 at the side of the cavity 12*a* includes the grain refining agent of the cobalt compound, a large number of crystal nuclei are formed in an initial stage of the solidification of the molten Ni alloy. This makes it possible to refine the grain.

Examples of the cobalt compound which may be used as the grain refining agent include cobalt aluminate, cobalt oxide, cobalt acetate, cobalt sulfate, cobalt chloride, cobalt sulfonate, ammonium cobalt sulfate, cobalt thiocyanate, and cobalt nitrate. These cobalt compounds may be commercially-available ones.

As the refractory material, ceramics such as alumina, zircon (zirconium silicate), zirconia, yttria may be used.

The backup layer 12*c* is made from the refractory material, and has a function of holding the casting strength. Examples of the refractory material which may be used for the backup layer 12*c* are ceramics having larger mechanical strength, such as alumina, zircon (zirconium silicate), silica and mullite may be used.

A general lost wax process or the like may be used as a method of manufacturing the mold 12. The manufacturing of the mold 12 using the lost wax process may be achieved, for example by applying slurry containing the grain refining agent of the cobalt compound to a wax model of the turbine blade or the like, and thereafter applying slurry for the backup layer thereon, followed by drying, dewaxing and baking.

Figure 4:
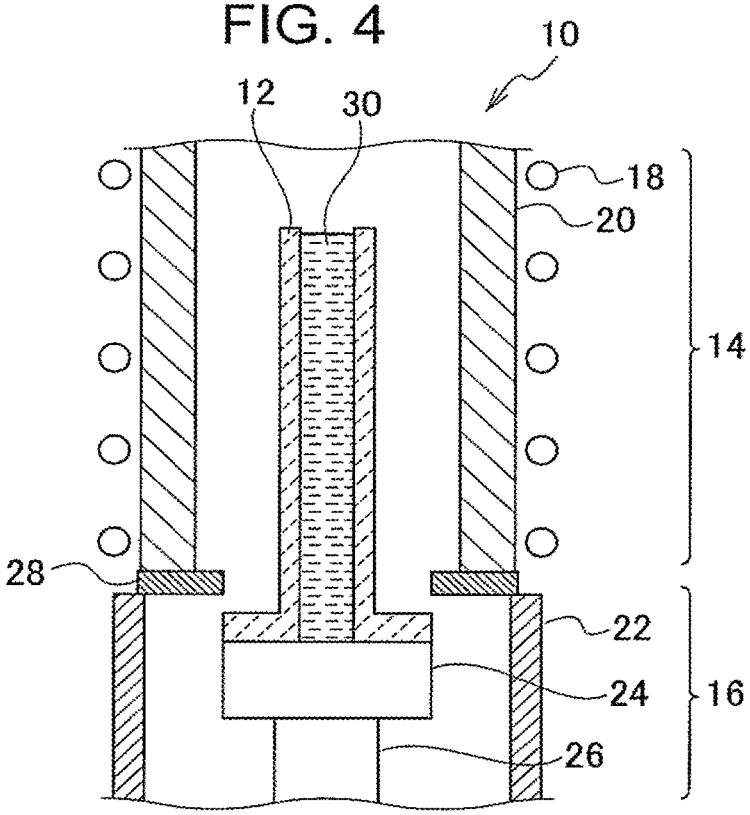
FIG. 4 is a diagram for explaining a casting step in the embodiment of the present disclosure.

The casting step (S10) is a step of casting the molten Ni alloy by pouring the molten Ni alloy into the cavity 12*a* of the mold 12. FIG. 4 is a diagram for explaining the casting step (S10).

To begin with, a vacuum atmosphere is created in the chamber by evacuating the chamber. The vacuum degree is in a range of 0.013 Pa ($1\times10^{-4}$ Torr) to 0.13 Pa ($1\times10^{-3}$ Torr). Incidentally, instead of the vacuum atmosphere, an inert gas atmosphere may be created in the chamber by introducing an inert gas such as an argon gas into the chamber after evacuating the chamber. Thereafter, molten Ni alloy 30 is poured into the cavity 12*a* of the mold 12 by tilting the melting crucible. The casting temperature may be 100° C. or more but 150° C. or less higher than the liquidus line of the Ni alloy. This is because casting defects are more likely to occur due to misrun and the like in a case where the casting temperature is lower than a temperature 100° C. above the liquidus line of the Ni alloy. Meanwhile, this is because the grain is more likely to become coarse in a case where the casting temperature is higher than a temperature 150° C. above the liquidus line of the Ni alloy. For example, in a case where Rene 77, which is a Ni-base superalloy, is used as the Ni alloy, the casting temperature may be set at 1480° C. or more, but at 1530° C. or less, because the liquidus line temperature of Rene 77 is approximately 1380° C. Incidentally, as reported for example in U.S. Pat. No. 4,478,638, Rene 77 contains Co (cobalt) in an amount of 14.2% by mass to 15.8% by mass, Cr (chromium) in an amount of 14.0% by mass to 15.3% by mass, Al (aluminum) in an amount of 4.0% by mass to 4.6% by mass, Ti (titanium) in an amount of 3.0% by mass to 3.7% by mass, Mo (molybdenum) in an amount of 3.9% by mass to 4.5% by mass, C (carbon) in an amount of 0.05% by mass to 0.09% by mass, B (boron) in an amount of 0.012% by mass to 0.02% by mass, Fe(iron) in an amount of 0.5% by mass or less, and Si (silicon) in an amount of 0.2% by mass or less. The rest of Rene77 is made from nickel and inevitable impurities.

The mold temperature may be 20° C. or more but 50° C. or less higher than the liquidus line of the Ni alloy. This is because the molten Ni alloy 30 is likely not to solidify unidirectionally from the upper surface of the water-cooling chill plate 24 since the molten Ni alloy 30 starts to solidify from the grain refined layer 12*b* of the mold 12 as well, in a case where the mold temperature is lower than a temperature 20° C. above the liquidus line of the Ni alloy. Meanwhile, this is because the effect of refining the grain is likely to decrease since the grain refining agent of the cobalt compound contained in the grain refined layer 12*b* melts into the molten Ni alloy 30, in a case where the mold temperature is higher than a temperature 50° C. above the liquidus line of the Ni alloy. For example, in a case where Rene 77, which is a Ni-base superalloy, is used as the Ni alloy, the mold temperature may be set at 1400° C. or more, but at 1430° C. or less, because the liquidus line of Rene 77 is approximately 1380° C.

Figure 5:
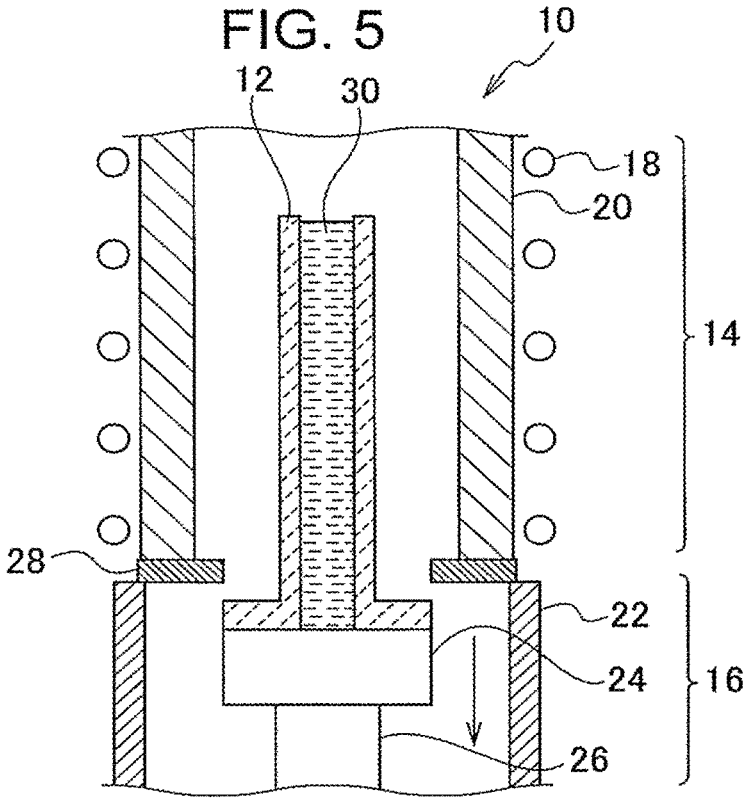
FIG. 5 is a diagram for explaining a columnar grain forming step in the embodiment of the present disclosure.

The columnar grain forming step (S12) is a step of forming the columnar grain by solidifying the molten Ni alloy 30 while drawing the mold 12, in which the molten Ni alloy 30 has been poured, at a drawing speed of 100 mm/hour or more but 400 mm/hour or less with a temperature gradient provided to a solid-liquid interface (solidification interface). FIG. 5 is a diagram for explaining the columnar grain forming step (S12).

The solidification is performed by moving the water-cooling chill plate 24 downward, and thereby drawing the mold 12, in which the molten Ni alloy 30 has been poured, from the heating zone 14 to the cooling zone 16 at the drawing speed of 100 mm/hour or more but 400 mm/hour or less with the temperature gradient provided to the solid-liquid interface (at the position of the heat shielding plate 28). Thus, the molten Ni alloy 30 is cooled and solidified unidirectionally from the upper surface of the water-cooling chill plate 24 to the upper part of the mold 12. Thereby, the grain unidirectionally grows to form the columnar grain. The reason why the drawing speed is 100 mm/hour or more is that a drawing speed of less than 100 mm/hour decreases the solidification rate, and accordingly decreases the productivity of the Ni alloy casting. Meanwhile, the reason why the drawing speed is 400 mm/hour or less is that a drawing speed of more than 400 mm/hour increases the solidification rate, and accordingly makes the equiaxed grain likely to be formed. The drawing speed may be set at 150 mm/hour or more, but 250 mm/hour or less.

To form the columnar grain, the temperature gradient of the solid-liquid interface (solidification interface) may be set at 80° C./cm or more in order to inhibit crystal nuclei from being formed by the grain refined layer 12*b* of the mold 12. This is because when the drawing speed is 100 mm/hour or more but 400 mm/hour or less, the temperature gradient of the solid-liquid interface at less than 80° C./cm makes it difficult to inhibit crystal nuclei from being formed by the grain refined layer 12*b*, and increases a possibility of forming the equiaxed grain. According to a relationship among the temperature gradient of the solid-liquid interface, the drawing speed and the metal structure, a larger temperature gradient of the solid-liquid interface and a lower drawing speed (a lower solidification rate) make it more likely to form the columnar grain, while a smaller temperature gradient of the solid-liquid interface and a higher drawing speed (a higher solidification rate) make it more likely to form the equiaxed grain. For this reason, in the case where the drawing speed is 100 mm/hour or more but 400 mm/hour or less, the temperature gradient of the solid-liquid interface at 80° C./cm or more, that is to say, a higher temperature gradient of the solid-liquid interface than that for the general unidirectional solidification, makes it possible to inhibit crystal nuclei from being formed by the grain refined layer 12*b*.

The higher temperature gradient of the solid-liquid interface may be achieved by positioning the mold 12, for example, by beforehand moving the position of the bottom surface of the mold 12 from a reference position (position of the heat shielding plate 28) toward the cooling zone 16 by a predetermined amount in the casting step (S10). This makes it possible to make the temperature gradient of the solid-liquid interface higher than in a case where the unidirectional solidification starts with the position of the bottom surface of the mold 12 located at the reference position (position of the heat shielding plate 28). The amount of movement of the mold 12 toward the cooling zone 16 varies depending on the temperature gradient of the solid-liquid interface. In a case where the temperature gradient of the solid-liquid interface is 80° C./cm or more, the amount of movement of the mold 12 toward the cooling zone 16 may be set in a range of 20 mm to 30 mm.

The position of the mold 12 can be adjusted by moving the water-cooling chill plate 24 downward.

The length of the columnar grain can be controlled based on the drawing time. For example, the drawing speed can be set at 200 mm/hour to obtain the columnar grain with a length of 200 mm, by setting the drawing time at one hour.

Figure 6:
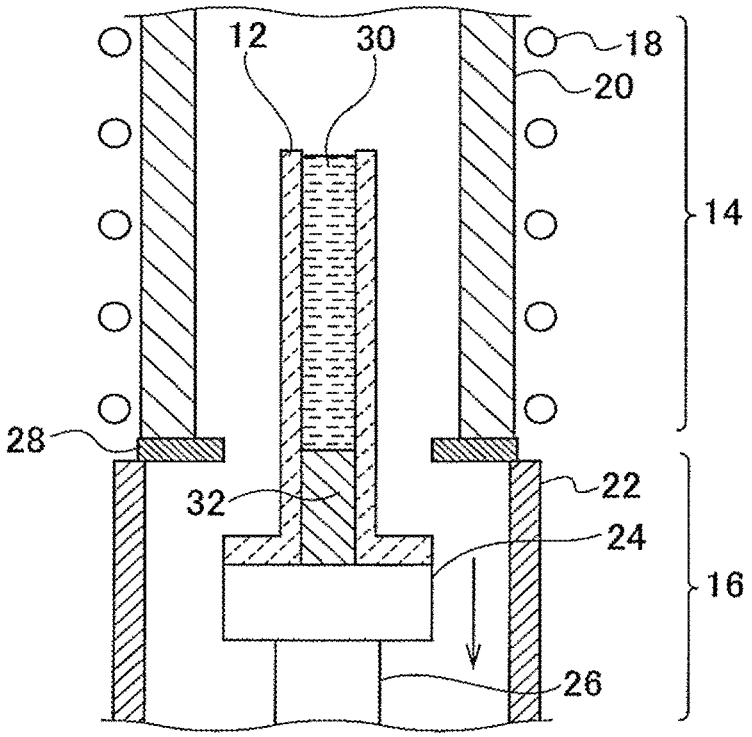
FIG. 6 is a diagram for explaining an equiaxed grain forming step in the embodiment of the present disclosure.

The equiaxed grain forming step (S14) is a step of forming the equiaxed grain by solidifying the molten Ni alloy while drawing the mold at a drawing speed of 1000 mm/minute or more continuously after the columnar grain forming step (S12). FIG. 6 is a diagram for explaining the equiaxed grain forming step (S14).

The molten Ni alloy is solidified while drawing the mold by moving the water-cooling chill plate 24 downward at a drawing speed of 1000 mm/minute or more continuously after the columnar grain forming step (S12). Thereby, the equiaxed grain can be formed continuing from a columnar grain 32. The reason why the drawing speed is 1000 mm/minute or more is that a drawing speed of less than 1000 mm/minute decreases the solidification rate, and accordingly makes it unlikely to form the equiaxed grain. Since the mold 12 is provided with the grain refined layer 12*b*, the equiaxed grain with refined grain can be formed.

Figure 7:
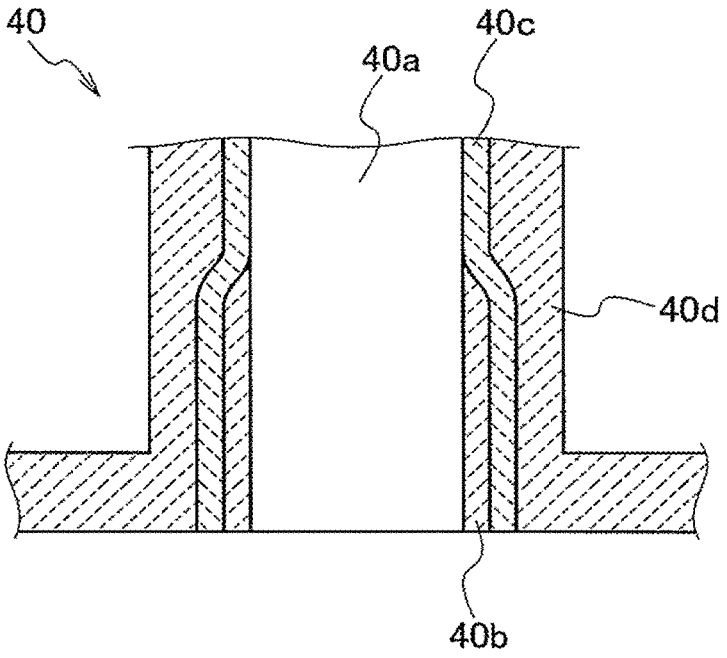
FIG. 7 is a diagram illustrating a configuration of another mold in the embodiment of the present disclosure.

Instead of the mold 12 having the above-discussed configuration, another mold may be used. FIG. 7 is a diagram illustrating a configuration of another mold 40. In a cavity 40*a*-side portion of the mold 40, a columnar grain forming area is provided with a refractory material layer 40*b* containing no grain refining agent of the cobalt compound, and made from the refractory material such as alumina, while an equiaxed grain forming area in the cavity 40*a*-side portion is provided with a grain refined layer 40*c* made from the grain refining agent containing the cobalt compound. Furthermore, a backup layer 40*d* is provided outside the grain refined layer 40*c*. Since as discussed above, the mold 40 includes the grain refined layer 40*c*, containing the grain refining agent of the cobalt compound, in the equiaxed grain forming area in the cavity 40*a*-side portion of the mold 40, but no grain refined layer 40*c* in the columnar grain forming area in the cavity 40*a*-side portion of the mold 40, the temperature gradient of the solid-liquid interface need not be made larger to inhibit crystal nuclei from being formed while the columnar grain is being formed. This makes the mold position work and the like unnecessary.

A general lost wax process or the like may be used as a method of manufacturing the mold 40. The manufacturing of the mold 40 using the lost wax process may be achieved, for example by applying slurry of alumina or the like, not containing the grain refining agent of the cobalt compound, only to the columnar grain forming area of a wax model of the turbine blade or the like, thereafter applying slurry containing the grain refining agent of the cobalt compound to the equiaxed grain forming area of the wax model, and subsequently applying slurry for the backup layer thereon, followed by drying, dewaxing and baking.

Figure 8:
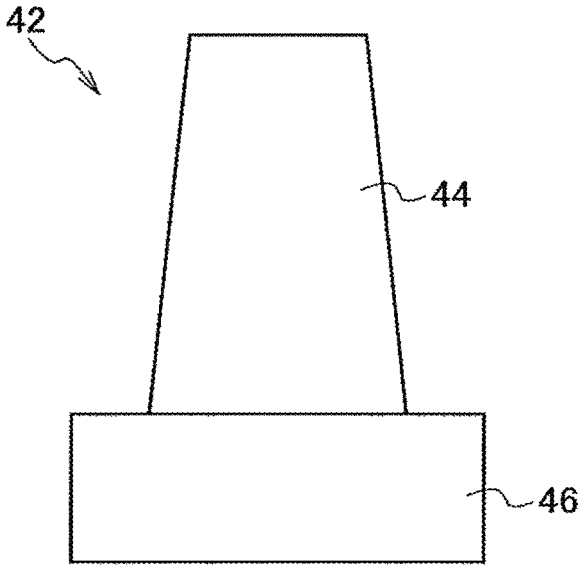
FIG. 8 is a schematic diagram illustrating a configuration of a turbine blade in the embodiment of the present disclosure.

It should be noted that no specific restriction is imposed to the Ni alloy used to cast the Ni alloy casting, and for example, a Ni-based superalloy such as an Inconel alloy to be used for the turbine blade or the like may be used as the Ni alloy. Furthermore, although no specific restriction is imposed on the Ni alloy casting, the Ni alloy casting may be a turbine blade. FIG. 8 is a schematic diagram illustrating a configuration of a turbine blade 42. An airfoil portion 44 of the turbine blade 42 is formed from the columnar grain and a dovetail portion 46 of the turbine blade 42 is formed from the equiaxed grain. The turbine blade 42 having excellent strength characteristics can be manufactured with creep strength increased in the airfoil portion 44 and fatigue strength increased in the dovetail portion 46.

According to the foregoing configuration, as discussed above, the method of manufacturing the Ni alloy casting includes the casting step of casting the molten Ni alloy by pouring the molten Ni alloy into the cavity of the mold, the columnar grain forming step of forming the columnar grain by solidifying the molten Ni alloy while drawing the mold, in which the molten Ni alloy has been poured, at the drawing speed of 100 mm/hour or more but 400 mm/hour or less with the temperature gradient provided to the solid-liquid interface, and the equiaxed grain forming step of forming the equiaxed grain by solidifying the molten Ni alloy while drawing the mold at a drawing speed of 1000 mm/minute or more continuously after the columnar grain forming step. For this reason, after the columnar grain is formed, the equiaxed grain is formed continuing from the columnar grain. Thus, the casting work need not be performed several times. Thereby, the casting work is reduced, and the productivity of the Ni alloy casting can be accordingly improved.

According to the foregoing configuration, the mold includes the grain refined layer in its cavity-side portion, the grain refined layer containing the grain refining agent of the cobalt compound, and in the columnar grain forming step, the temperature gradient of the solid-liquid interface is set at 80° C./cm or more in order to inhibit crystal nuclei from being formed by the grain refined layer. Thus, while the columnar grain is being formed, crystal nuclei are inhibited from being formed by the grain refined layer of the mold, and while the equiaxed grain is being formed, crystal nuclei are formed by the grain refined layer of the mold, and grain having refined equiaxed grain can be formed. In this manner, after the columnar grain is formed, the refined equiaxed grain can be formed continuing from the columnar grain, although the columnar grain forming area in the cavity-side portion of the mold is provided with the grain refined layer. For this reason, the productivity of the Ni alloy casting can be improved. In addition, since the columnar grain and the refined equiaxed grain can be formed continuously although the columnar grain forming area in the cavity-side portion of the mold is provided with the grain refined layer, the mold is easily manufactured. Thus, the productivity of the Ni alloy casting is improved. Furthermore, since no vibration device or the like is needed to refine the grain, the manufacturing cost of the Ni alloy casting can be reduced.

According to the foregoing configuration, the mold includes the grain refined layer in only the equiaxed grain forming area in the cavity-side portion of the mold, the grain refined layer containing the grain refining agent of the cobalt compound. Thus, while the columnar grain is being formed, crystal nuclei are inhibited from being formed, and while the equiaxed grain is being formed, crystal nuclei are formed by the grain refined layer, and the equiaxed grain can become accordingly refined. Thereby, the columnar grain and the refined equiaxed grain can be formed continuously. For this reason, the productivity of the Ni alloy casting can be improved. In addition, since while the columnar grain is being formed, the temperature gradient of the solid-liquid interface need not be made higher to inhibit the formation of crystal nuclei, work for adjusting the position of the mold to make the temperature gradient higher is unnecessary, and the productivity of the Ni alloy casting can be accordingly improved.

EXAMPLE

A casting test was performed on the Ni alloy casting.

(Casting Method)

A rectangular sheet of the Ni alloy casting was cast. Rene 77, which is a Ni-based superalloy, was used as the Ni alloy. A casting apparatus having the same configuration as the casting apparatus 10 illustrated in FIG. 2 was used. A mold having the same configuration as the mold 12 illustrated in FIG. 3 was used. Cobalt aluminate was used as the cobalt compound contained in the grain refined layer. The backup layer was made from alumina.

The mold was placed on the water-cooling chill plate. Thereafter, the water-cooling chill plate was moved downward until the mold was drawn toward the cooling zone by 20 mm, where the mold was positioned for the purpose of making the temperature gradient of the solid-liquid interface higher to form the columnar grain. The molten Ni alloy was poured into the cavity of the mold. The casting temperature was set at 1530° C. The mold temperature was set at 1430° C. The temperature of the water-cooling chill plate was set at 300° C. The vacuum degree was set at 0.013 Pa ($1\times10^{-4}$ Torr).

Thereafter, the molten Ni alloy was solidified while drawing the mold, containing the poured molten Ni alloy, from the heating zone to the cooling zone at a drawing speed of 150 mm/hour to 250 mm/hour with the temperature gradient provided to the solid-liquid interface by moving the water-cooling chill plate downward. Thereby, the columnar grain was formed. The temperature gradient of the solid-liquid interface was set at 80° C./cm to 100° C./cm.

After the columnar grain was formed, the rest of the molten Ni alloy was continuously solidified while drawing the mold from the heating zone to the cooling zone at a drawing speed of 1000 mm/minute by moving the water-cooling chill plate downward. Thereby, the equiaxed grain was formed.

(Observation of Appearance)

Figure 9:
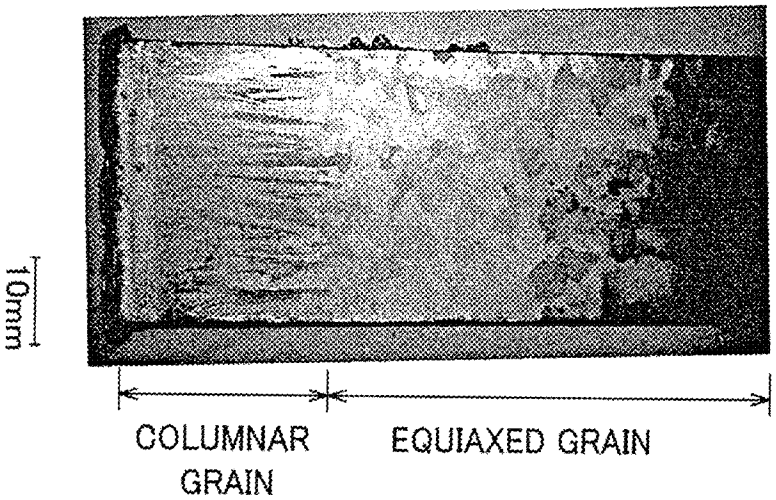
FIG. 9 is a photograph showing a result of observing an appearance of the Ni alloy casting in the embodiment of the present disclosure.

The appearance of the Ni alloy casting was observed. FIG. 9 is a photograph showing a result of observing the appearance of the Ni alloy casting. As shown in FIG. 9, the columnar grain was formed in the lower portion of the Ni alloy casting, while the refined equiaxed grain was formed in the upper portion of the Ni alloy casting. Like this, the Ni alloy casting was such that the refined equiaxed grain was formed continuing from the columnar grain. Furthermore, the columnar grain was such that no equiaxed grain was observed in the area where the columnar grain was formed. From these, it is learned that the larger temperature gradient of the solid-liquid interface during the forming of the columnar grain makes it possible to inhibit crystal nuclei from being formed by the grain refined layer.

(Observation of Microstructure)

Figure 10B:
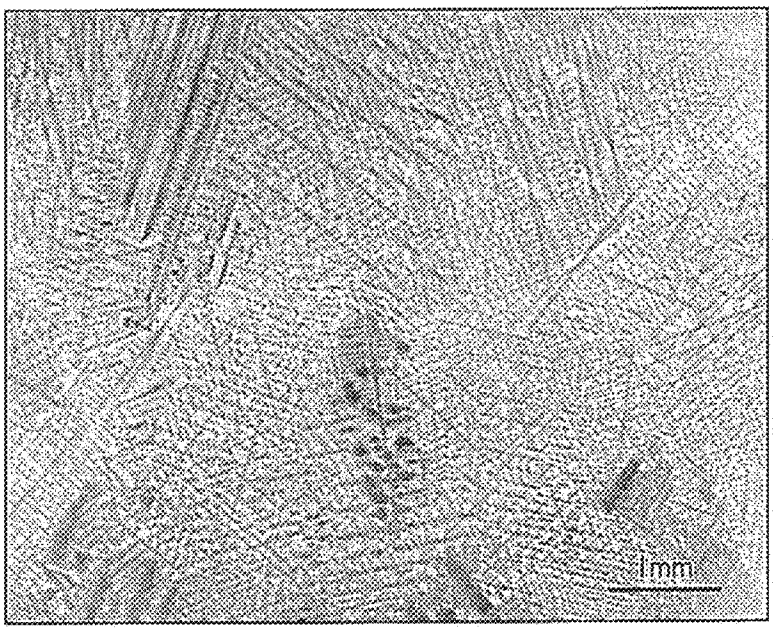
FIG. 10B is a photograph showing a result of observing a microstructure of the area where the equiaxed grain was formed in the embodiment of the present disclosure.
Figure 10A:
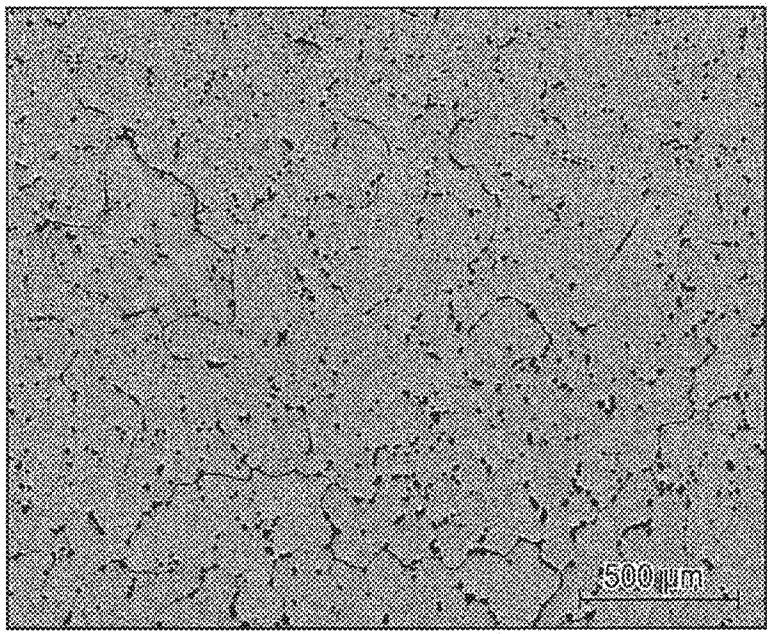
FIG. 10A is a photograph showing a result of observing a microstructure of the area where the columnar grain was formed in the embodiment of the present disclosure.

The microstructure of the Ni alloy casting was observed using an optical microscope. FIGS. 10A and 10B are photographs showing a result of observing a microstructure of the Ni alloy casting. FIG. 10A is a photograph showing a result of observing a microstructure of the area where the columnar grain was formed, while FIG. 10B is a photograph showing a result of observing a microstructure of the area where the equiaxed grain was formed. The observation of the microstructure was performed to observe a metal structure in a direction orthogonal to the direction in which the Ni alloy casting was drawn. In addition, for each of the columnar grain and the equiaxed grain, the grain size was obtained by averaging grain sizes of the respective multiple grains which were measured in the metal structure in the direction orthogonal to the direction in which the Ni alloy casting was drawn. The result was that the grain size of the columnar grain was 0.45 mm to 0.55 mm, and the grain size of the equiaxed grain was 1 mm to 4 mm.

According to this disclosure, the continuous change in the drawing speed after the casting makes it possible to form the columnar grain and thereafter continuously the equiaxed grain. For this reason, this disclosure is useful to manufacture the Ni alloy casting such as the turbine blade.

What is claimed is:

1. A method of manufacturing a Ni alloy casting, comprising:

a casting step of casting molten Ni alloy by pouring the molten Ni alloy into a cavity of a mold;

a columnar grain forming step of forming columnar grain by solidifying the molten Ni alloy while drawing the mold, in which the molten Ni alloy has been poured, at a drawing speed of 100 mm/hour or more but 400 mm/hour or less with a temperature gradient provided to a solid-liquid interface; and an equiaxed grain forming step of forming equiaxed grain by solidifying the molten Ni alloy while drawing the mold at a drawing speed of 1000 mm/minute or more continuously after the columnar grain forming step.

2. The method of manufacturing a Ni alloy casting according to claim 1, wherein the mold includes a grain refined layer in a cavity-side portion of the mold, the grain refined layer containing a grain refining agent of a cobalt compound, and in the columnar grain forming step, the temperature gradient of the solid-liquid interface is set at 80° C./cm or more.

3. The method of manufacturing a Ni alloy casting according to claim 1, wherein the mold includes a grain refined layer in an equiaxed grain forming area in a cavity-side portion of the mold, the grain refined layer containing a grain refining agent of a cobalt compound, and the mold includes no grain refined layer in a columnar grain forming area in the cavity-side portion of the mold.

4. The method of manufacturing a Ni alloy casting according to claim 2, wherein the grain refining agent is any one of cobalt aluminate, cobalt oxide, cobalt acetate, cobalt sulfate, cobalt chloride, cobalt sulfonate, ammonium cobalt sulfate, cobalt thiocyanate and cobalt nitrate.

5. The method of manufacturing a Ni alloy casting according to claim 3, wherein the grain refining agent is any one of cobalt aluminate, cobalt oxide, cobalt acetate, cobalt sulfate, cobalt chloride, cobalt sulfonate, ammonium cobalt sulfate, cobalt thiocyanate and cobalt nitrate.

6. The method of manufacturing a Ni alloy casting according to claim 1, wherein the Ni alloy casting is a turbine blade, an airfoil portion of the turbine blade is made from the columnar grain, and a dovetail portion of the turbine blade is made from the equiaxed grain.

7. The method of manufacturing a Ni alloy casting according to claim 2, wherein the Ni alloy casting is a turbine blade, an airfoil portion of the turbine blade is made from the columnar grain, and a dovetail portion of the turbine blade is made from the equiaxed grain.

8. The method of manufacturing a Ni alloy casting according to claim 3, wherein the Ni alloy casting is a turbine blade, an airfoil portion of the turbine blade is made from the columnar grain, and a dovetail portion of the turbine blade is made from the equiaxed grain.

9. The method of manufacturing a Ni alloy casting according to claim 4, wherein the Ni alloy casting is a turbine blade, an airfoil portion of the turbine blade is made from the columnar grain, and a dovetail portion of the turbine blade is made from the equiaxed grain.

10. The method of manufacturing a Ni alloy casting according to claim 5, wherein the Ni alloy casting is a turbine blade, an airfoil portion of the turbine blade is made from the columnar grain, and a dovetail portion of the turbine blade is made from the equiaxed grain.

11. A Ni alloy casting manufactured using the method of manufacturing a Ni alloy casting according to claim 1, wherein a grain size of the columnar grain in a direction orthogonal to a direction of the drawing is in a range of 0.45 mm to 0.55 mm.

12. A Ni alloy casting manufactured using the method of manufacturing a Ni alloy casting according to claim 2, wherein a grain size of the columnar grain in a direction orthogonal to a direction of the drawing is in a range of 0.45 mm to 0.55 mm.

13. A Ni alloy casting manufactured using the method of manufacturing a Ni alloy casting according to claim 3, wherein a grain size of the columnar grain in a direction orthogonal to a direction of the drawing is in a range of 0.45 mm to 0.55 mm.

14. A Ni alloy casting manufactured using the method of manufacturing a Ni alloy casting according to claim 4, wherein a grain size of the columnar grain in a direction orthogonal to a direction of the drawing is in a range of 0.45 mm to 0.55 mm.

15. A Ni alloy casting manufactured using the method of manufacturing a Ni alloy casting according to claim 5, wherein a grain size of the columnar grain in a direction orthogonal to a direction of the drawing is in a range of 0.45 mm to 0.55 mm.

16. A Ni alloy casting manufactured using the method of manufacturing a Ni alloy casting according to claim 6, wherein a grain size of the columnar grain in a direction orthogonal to a direction of the drawing is in a range of 0.45 mm to 0.55 mm.

17. A Ni alloy casting manufactured using the method of manufacturing a Ni alloy casting according to claim 7, wherein a grain size of the columnar grain in a direction orthogonal to a direction of the drawing is in a range of 0.45 mm to 0.55 mm.

18. A Ni alloy casting manufactured using the method of manufacturing a Ni alloy casting according to claim 8, wherein a grain size of the columnar grain in a direction orthogonal to a direction of the drawing is in a range of 0.45 mm to 0.55 mm.

19. A Ni alloy casting manufactured using the method of manufacturing a Ni alloy casting according to claim 9, wherein a grain size of the columnar grain in a direction orthogonal to a direction of the drawing is in a range of 0.45 mm to 0.55 mm.

20. A Ni alloy casting manufactured using the method of manufacturing a Ni alloy casting according to claim 10, wherein a grain size of the columnar grain in a direction orthogonal to a direction of the drawing is in a range of 0.45 mm to 0.55 mm.

* * * * *